US011603649B2

(12) United States Patent
Littlejohn

(10) Patent No.: US 11,603,649 B2
(45) Date of Patent: Mar. 14, 2023

(54) SINK DRAIN DEVICE

(71) Applicant: Travis Littlejohn, Verdale, WA (US)

(72) Inventor: Travis Littlejohn, Verdale, WA (US)

( * ) Notice: Subject to any disclaimer, the term of this patent is extended or adjusted under 35 U.S.C. 154(b) by 0 days.

(21) Appl. No.: 16/163,429

(22) Filed: Oct. 17, 2018

(65) Prior Publication Data

US 2020/0123749 A1 Apr. 23, 2020

(51) Int. Cl.
*E03C 1/264* (2006.01)
*E03C 1/22* (2006.01)

(52) U.S. Cl.
CPC ..... *E03C 1/264* (2013.01); *E03C 1/22* (2013.01)

(58) Field of Classification Search
CPC ..... E03C 1/264; E03C 1/22
USPC ..... 4/288, 629, 652
See application file for complete search history.

(56) References Cited

U.S. PATENT DOCUMENTS 2,225,693 A * 12/1940 Frances ..... E03C 1/264 4/288
2,279,683 A * 4/1942 Judell ..... E03C 1/262 4/288
3,711,874 A * 1/1973 Gajer ..... E03C 1/264 4/287
2015/0159354 A1* 6/2015 Laera ..... E03C 1/232 4/629

* cited by examiner

*Primary Examiner* — Tuan N Nguyen
(74) *Attorney, Agent, or Firm* — Christopher Pilling

(57) ABSTRACT

An improved sink drain device that includes a main sink drain member, upper and lower gaskets, a threaded ring and a plurality of pressure bolts. The sink drain is funnel shaped and has an outwardly extending flange at its top-most surface and has external threads on its outer surface. The threaded ring has internal threads that engage the external threads of the sink drain member. The threaded ring also has threaded apertures. The upper gasket is located between the sink drain flange and the top surface of the floor of a sink. The lower gasket is located between the lower surface of the sink and the rigid pressure ring. The pressure bolts thread into the apertures of the threaded ring causing the flange of the main sink drain member to be forced downward to form a water-tight seal with the floor of the sink base.

1 Claim, 7 Drawing Sheets

SINK DRAIN DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of sink drain assemblies and more specifically to an improved sink drain device that reduces the chances of leaks after installation.

Sinks commonly found in kitchens include a sink drain assembly that allows water to exit from the sink and down into a plumbing pipe that send the water and other small debris to a sewer line. The old-style sink basket, also referred to as a "strainer", has a flat flange that rests inside the sink. You must put plumbers putty or silicone under the strainer basket to ensure a water tight seal. When using silicone, the sink is unusable until it cures generally 24 hours.

When using plumbers putty, the drain is ready for use as soon as the putty has stopped oozing out to create the seal. A rubber washer is mounted under the sink with an additional cardboard ring to ensure you can tighten the locknut without grabbing the rubber seal. Below that at the bottom of the strainer are threads so that you can mount a tail piece washer and tail piece. This allows the transition to a standard slip joint style of drainage system. It is known by experienced plumbers that the number one leaking joint under kitchen sinks is the tail piece.

To help avoid leakage associated with the tail piece it would be helpful to have a design where the strainer/drain basket and the tail piece are molded as one piece, without traditional tightening rings. This configuration would ensure that the tail piece will never leak. An integral rubber flange is molded into the underside of the strainer which eliminates the need for plumber's putty or silicone adhesive, thereby making the drain usable immediately. The improved strainer of the present invention also includes a mounting system that allows two ways to tighten and secure the strainer to the sink. The first is a mounting nut that can be made tight or just snugged up. The second is four tension bolts located on a threaded ring that circles the strainer basket can be tightened against a secondary ring, that traps the strainer between the top of the sink and the underside of the sink, to make sure the basket seals to the sink. Once the basket is secure a plumber can slide a standard slip joint piece to connect to the drain line.

BRIEF SUMMARY OF THE INVENTION

The primary object of the invention is to provide an improved sink drain device that helps eliminate plumbing leaks.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a sink drain device comprising: a sink basket, a main sink drain member, a first gasket ring, a second gasket ring, a rigid pressure ring, a threaded ring, a plurality of pressure bolts, said sink basket fitting into said main sink drain member in a standard way, said main sink drain member being approximately funnel shaped and having an outwardly extending flange at its top-most surface and having external threads on its widest outer surface, said threaded ring having internal threads that engage said external threads of said main sink drain member, said threaded ring also having a plurality of evenly spaced threaded apertures, said first gasket ring located between said outwardly extending flange of said main sink drain member and the top surface of the floor of a standard sink aperture designed to accept a sink drain assembly, said second gasket ring located between the lower surface of said standard sink aperture and said rigid pressure ring, said pressure bolts threaded into said evenly spaced threaded apertures of said threaded ring impinging on said rigid pressure ring causing said flange of said main sink drain member to be forced downward and causing said first and second gaskets to form a water-tight seal with the floor of said sink base, and the lower portion of said main sink drain member being tubular and capable of engaging a standard slip joint drain line.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
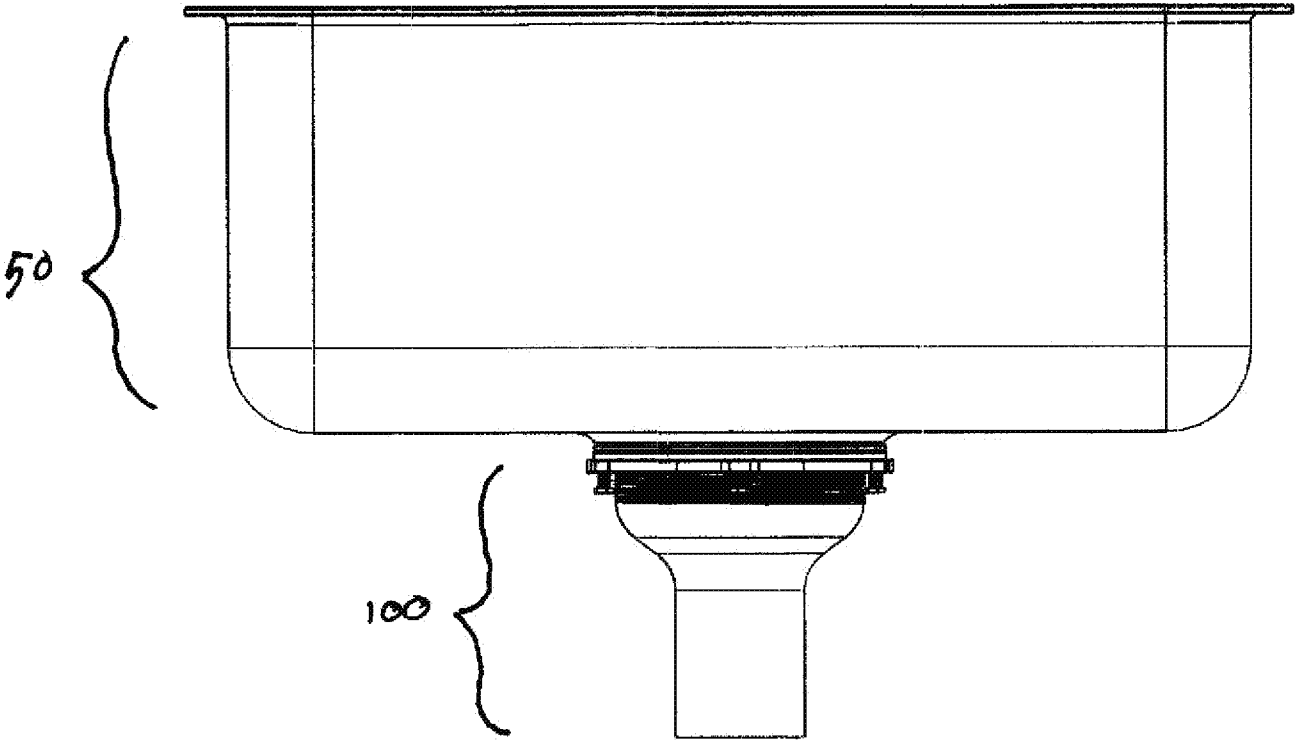
FIG. 1 is a front of the invention.

Referring now to FIG. 1 we see a front view of the invention 100 attached to a standard sink 50.

Figure 2:
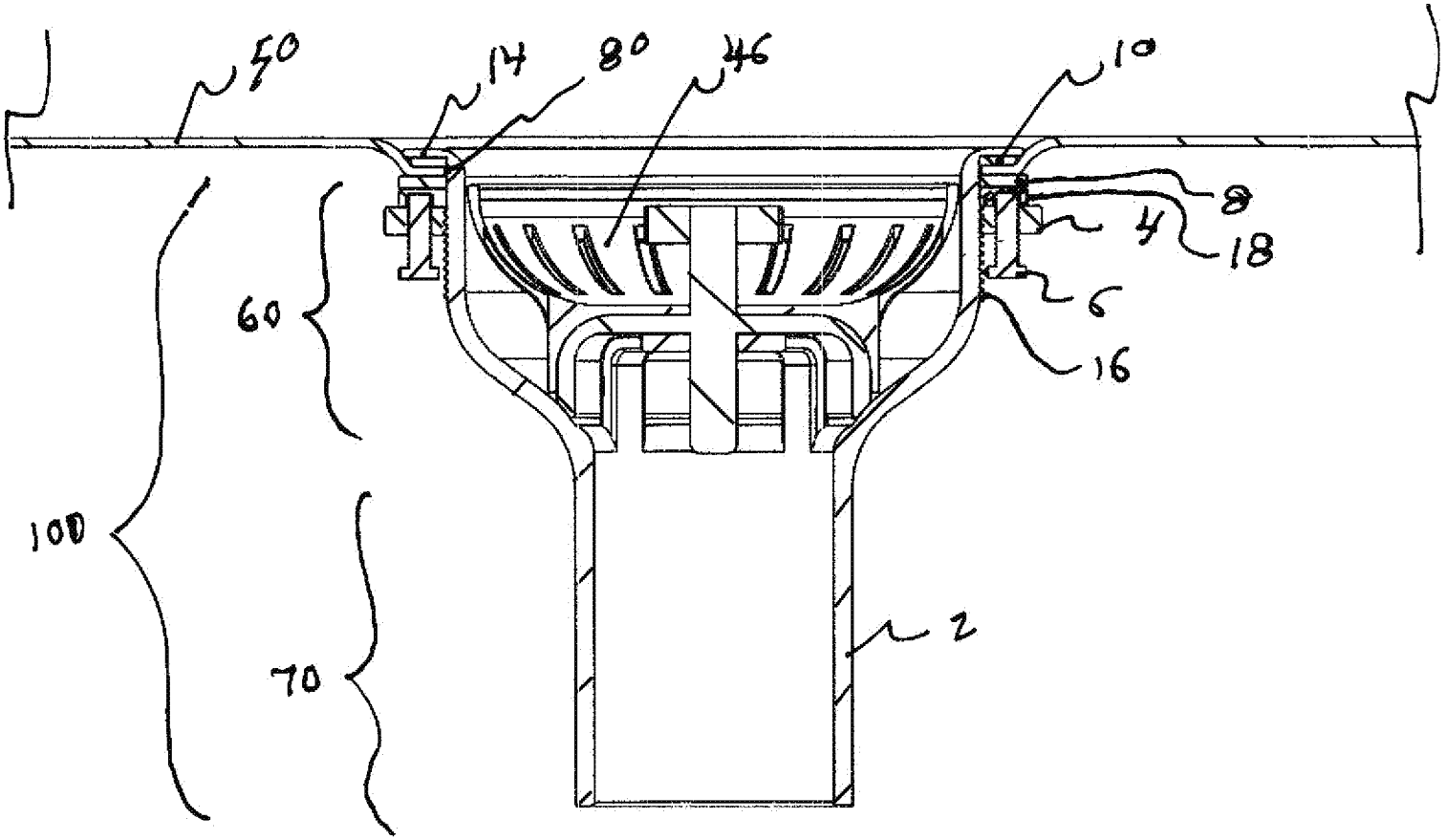
FIG. 2 is a front section view of the invention.

FIG. 2 is a front section view of the invention 100. a main sink basket 2 consists of a wider upper shape 60 and a smaller diameter lower shape 70 forming an approximate funnel shape. The wider upper shape 60 includes an upper flange 14 that sits on top of a first gasket ring 10 which is placed around the sink aperture 80 located at the floor of the sink 50. A threaded rigid ring 4 screws onto mating male threads 16. Tightening bolts 6 are screwed into apertures 19 shown in the perspective view in FIG. 6. The tips of the tightening bolts 6 are pushed up against a rigid ring 18 which in turn pushes up on a second gasket ring 8. A standard strainer basket 46 sits inside the wide portion 60 main sink basket 2. A standard waste water pipe, not shown is attached to the lower portion 70 of the main sink basket 2 by a standard slip fit connector, not shown.

Figure 3:
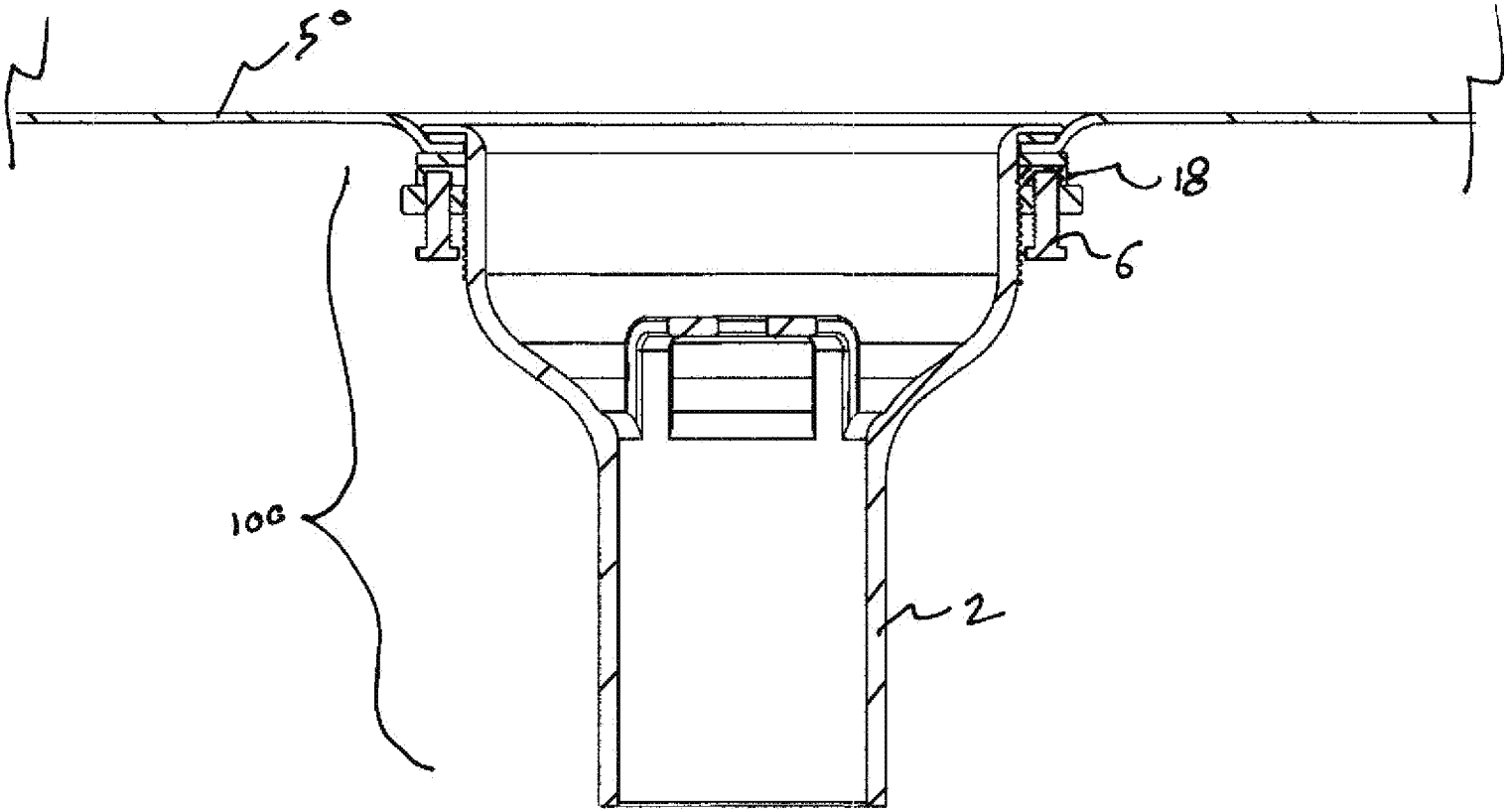
FIG. 3 is a front section view of the sink basket portion of the invention.

FIG. 3 is a front section view of the invention 100 without the removable strainer basket to further clarity in seeing the key features of the invention 100.

Figure 4:
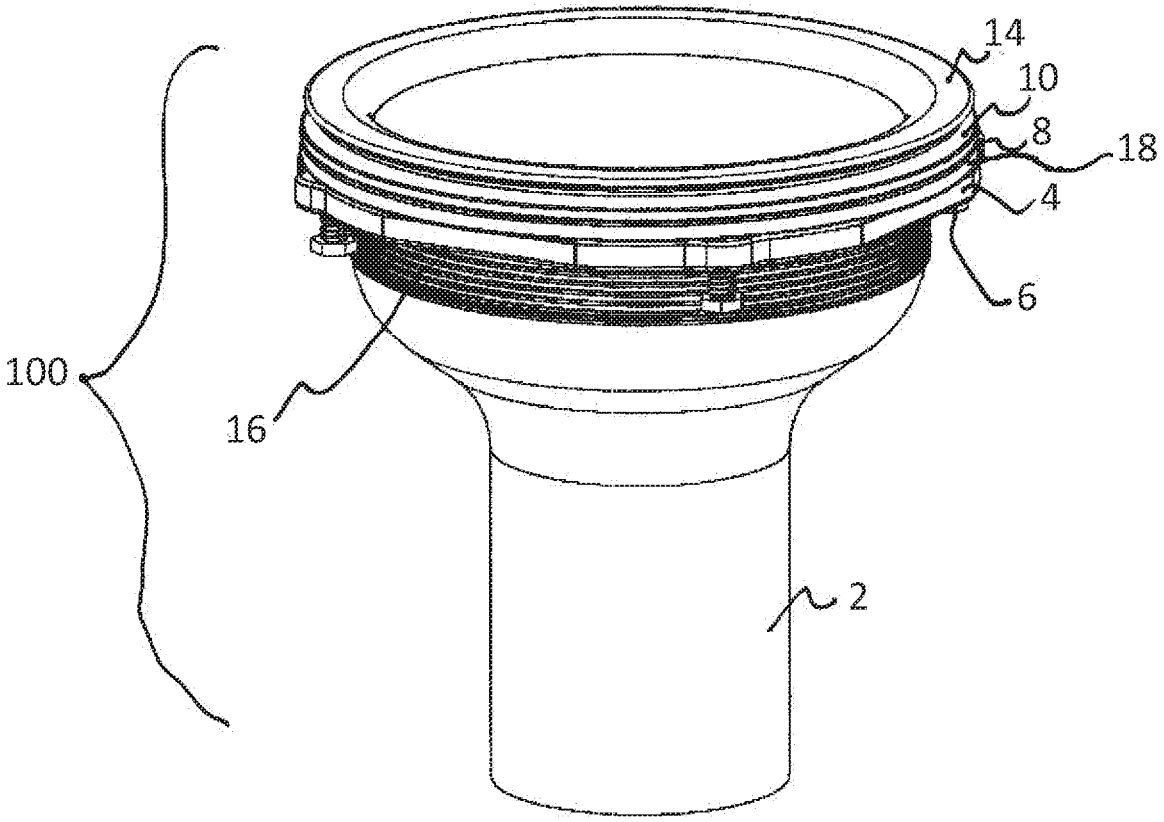
FIG. 4 is a perspective view of the invention.

FIG. 4 is a perspective view of the invention 100 clearly showing the treads 16 of the main sink basket 2 upon which the rigid threaded ring 4 is screwed onto.

Figure 5:
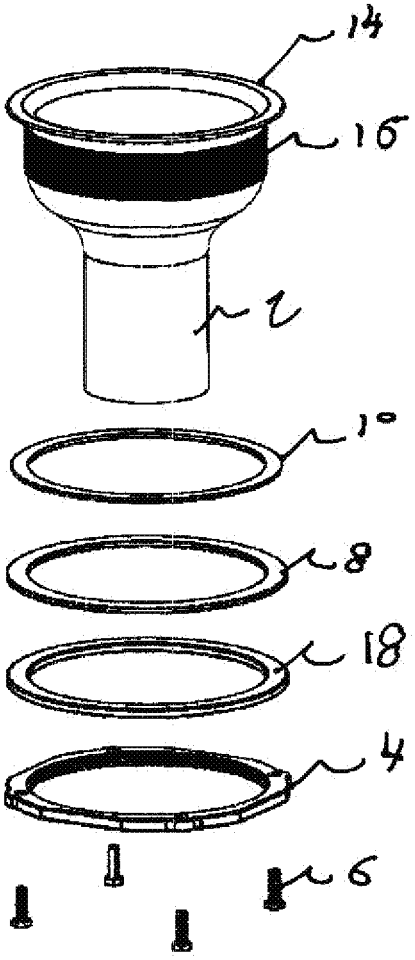
FIG. 5 is an exploded view of the invention.

FIG. 5 is an exploded view of the invention 100 showing all parts of the invention 100 as described above.

Figure 6:
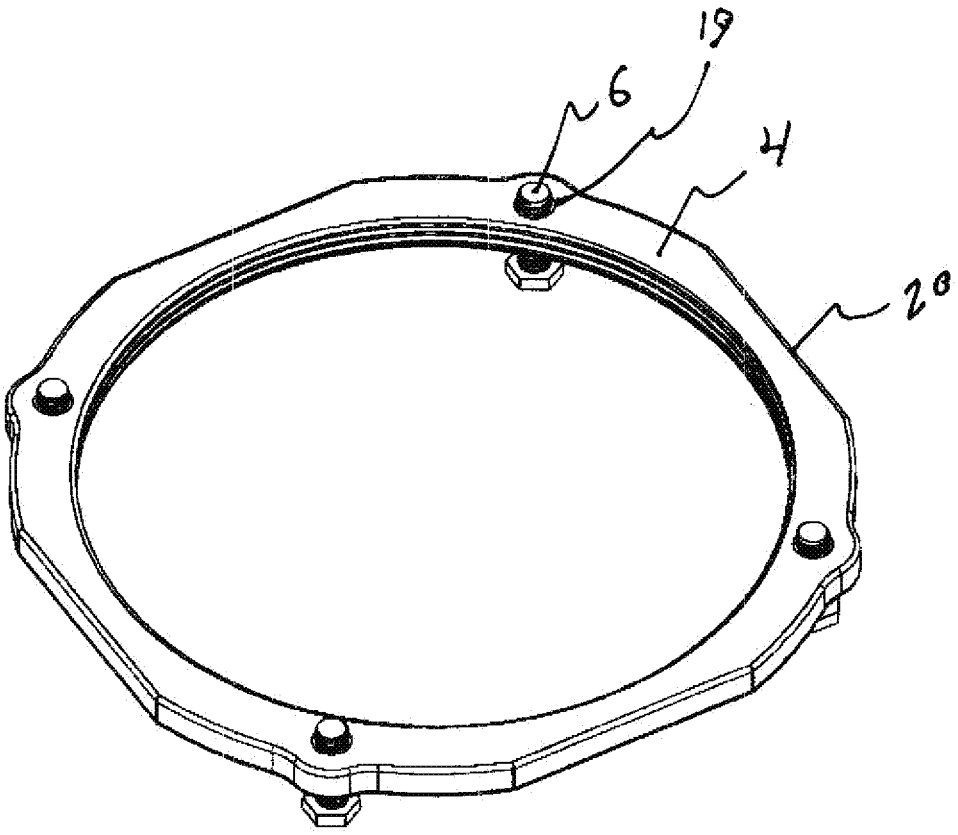
FIG. 6 is a perspective view of the threaded ring of the present invention.

FIG. 6 is a perspective view of the threaded ring 4 showing flat perimeter portions 20 that allows a plumber to tighten the ring 4 during instillation. Tightening bolts 6 are shown threaded into perimeter apertures 19.

Figure 7:
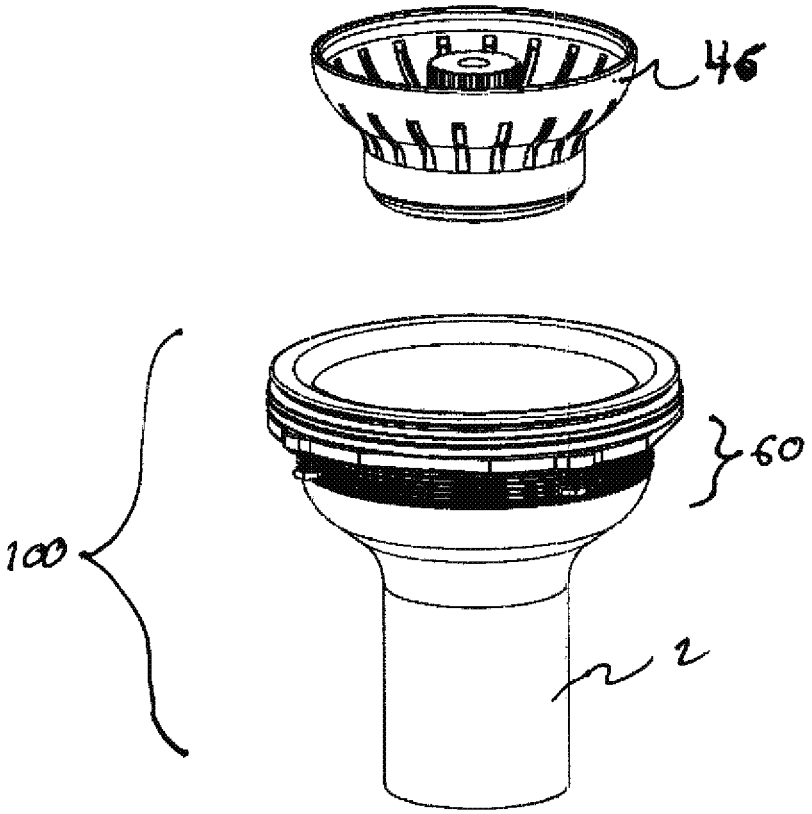
FIG. 7 is an exploded view showing the sink drain about to be inserted into the sink basket.

FIG. 7 is a perspective view of the invention 100 showing a standard strainer basket 46 about to be lowered into the wide portion 60 of the main sink basket 2.

The above description and accompanying drawings show an improved sink drain assembly that reduces the chance of leakage from fittings normally associated with standard sink drain assemblies.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A sink drain device comprising:

a sink drain basket;

a tail piece drain member, wherein said sink drain basket and said tail piece drain member are molded as one piece without the use of tightening rings;

a first gasket ring;

a second gasket ring;

a rigid pressure ring;

a threaded ring;

a plurality of pressure bolts;

a sink strainer configured to fit into said sink drain basket;

said sink drain basket being approximately funnel shaped and having an outwardly extending flange at its topmost surface and having external threads on its widest outer surface;

said threaded ring having internal threads that engage said external threads of said main sink drain basket;

said threaded ring also having a plurality of evenly spaced threaded apertures;

said first gasket ring located between said outwardly extending flange of said sink drain basket and the top surface of the floor of a standard sink aperture designed to accept a sink drain assembly;

said second gasket ring located between the lower surface of said standard sink aperture and said rigid pressure ring;

said pressure bolts threaded into said evenly spaced threaded apertures of said threaded ring impinging on said rigid pressure ring causing said flange of said main sink drain member to be forced downward and causing said first and second gaskets to form a water-tight seal with the floor of said sink base; and said tail piece drain member constructed as a lower portion of said sink drain basket being tubular and capable of engaging a standard slip joint drain line.

* * * * *